US011224115B2

(12) United States Patent
Hsu et al.

(10) Patent No.: US 11,224,115 B2
(45) **Date of Patent: *Jan. 11, 2022**

(54) SYSTEM AND METHOD FOR EXTREME ULTRAVIOLET SOURCE CONTROL

(71) Applicant: Taiwan Semiconductor Manufacturing Co., Ltd., Hsinchu (TW)

(72) Inventors: Chun-Chia Hsu, Hsinchu (TW); Chieh Hsieh, Hsinchu (TW); Shang-Chieh Chien, New Taipei (TW); Li-Jui Chen, Hsinchu (TW); Po-Chung Cheng, Chiayi County (TW); Tzung-Chi Fu, Miaoli County (TW); Bo-Tsun Liu, Taipei (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/098,081

(22) Filed: Nov. 13, 2020

(65) Prior Publication Data

US 2021/0068241 A1 Mar. 4, 2021

Related U.S. Application Data

(63) Continuation of application No. 16/429,240, filed on Jun. 3, 2019, now Pat. No. 10,842,009, which is a continuation of application No. 15/905,951, filed on Feb. 27, 2018, now Pat. No. 10,314,154.

(60) Provisional application No. 62/591,924, filed on Nov. 29, 2017.

(51) Int. Cl.
*H05G 2/00* (2006.01)

(52) U.S. Cl.
CPC ..... *H05G 2/008* (2013.01)

(58) Field of Classification Search
CPC ..... H05G 2/008
USPC ..... 250/493.1, 504 R
See application file for complete search history.

(56) References Cited

U.S. PATENT DOCUMENTS

| | | | | |
|---|---|---|---|---|
| 9,625,824 | B2 | 4/2017 | Lu et al. | |
| 10,314,154 | B1 * | 6/2019 | Hsu | H05G 2/008 |
| 10,842,009 | B2 * | 11/2020 | Hsu | H05G 2/008 |
| 2008/0116400 | A1 | 5/2008 | Schmidt et al. | |
| 2013/0063803 | A1 | 3/2013 | Delgado et al. | |
| 2019/0166680 | A1 | 5/2019 | Hsu et al. | |

* cited by examiner

*Primary Examiner* — Nicole M Ippolito

(57) ABSTRACT

A method for extreme ultraviolet (EUV) lithography includes loading an EUV mask to a lithography system; loading a wafer to the lithography system, wherein the wafer includes a resist layer sensitive to EUV radiation; producing EUV radiation by heating target plumes using a radiation source; and exposing the resist layer to the EUV radiation while monitoring a speed of the target plumes.

20 Claims, 6 Drawing Sheets

SYSTEM AND METHOD FOR EXTREME ULTRAVIOLET SOURCE CONTROL

PRIORITY

This is a continuation of U.S. application Ser. No. 16/429,240, filed Jun. 3, 2019, now issued U.S. Pat. No. 10,842,009, which is a continuation of U.S. application Ser. No. 15/905,951, filed Feb. 27, 2018, issued U.S. Pat. No. 10,314,154, which claims the benefits of U.S. Prov. App. Ser. No. 62/591,924, filed Nov. 29, 2017, the entire disclosure of which is herein incorporated by reference.

BACKGROUND

The semiconductor integrated circuit (IC) industry has experienced exponential growth. Technological advances in IC materials and design have produced generations of ICs where each generation has smaller and more complex circuits than the previous generation. In the course of IC evolution, functional density (i.e., the number of interconnected devices per chip area) has generally increased while geometry size (i.e., the smallest component (or line) that can be created using a fabrication process) has decreased. This scaling down process generally provides benefits by increasing production efficiency and lowering associated costs. Such scaling down has also increased the complexity of processing and manufacturing ICs.

For example, the need to perform higher resolution lithography processes grows. One lithography technique is extreme ultraviolet lithography (EUVL). The EUVL employs scanners using light in the extreme ultraviolet (EUV) region, having a wavelength of about 1-100 nm. Some EUV scanners provide 4× reduction projection printing, similar to some optical scanners, except for that the EUV scanners use reflective rather than refractive optics, i.e., mirrors instead of lenses. One type of EUV light source is laser-produced plasma (LPP). LPP technology produces EUV light by focusing a high-power laser beam onto small tin droplets to form highly ionized plasma that emits EUV radiation at about 13.5 nm. The EUV light is then collected by an LPP collector and reflected by optics towards a lithography target, e.g., a wafer. The LPP collector is subjected to damages and degradations due to the impact of particles, ions, radiation, and most seriously, tin deposition. An object of the present disclosure is to improve efficiency of LPP EUV radiation sources and to reduce damages to LPP collectors.

BRIEF DESCRIPTION OF THE DRAWINGS

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion.

DETAILED DESCRIPTION

Figure 1:
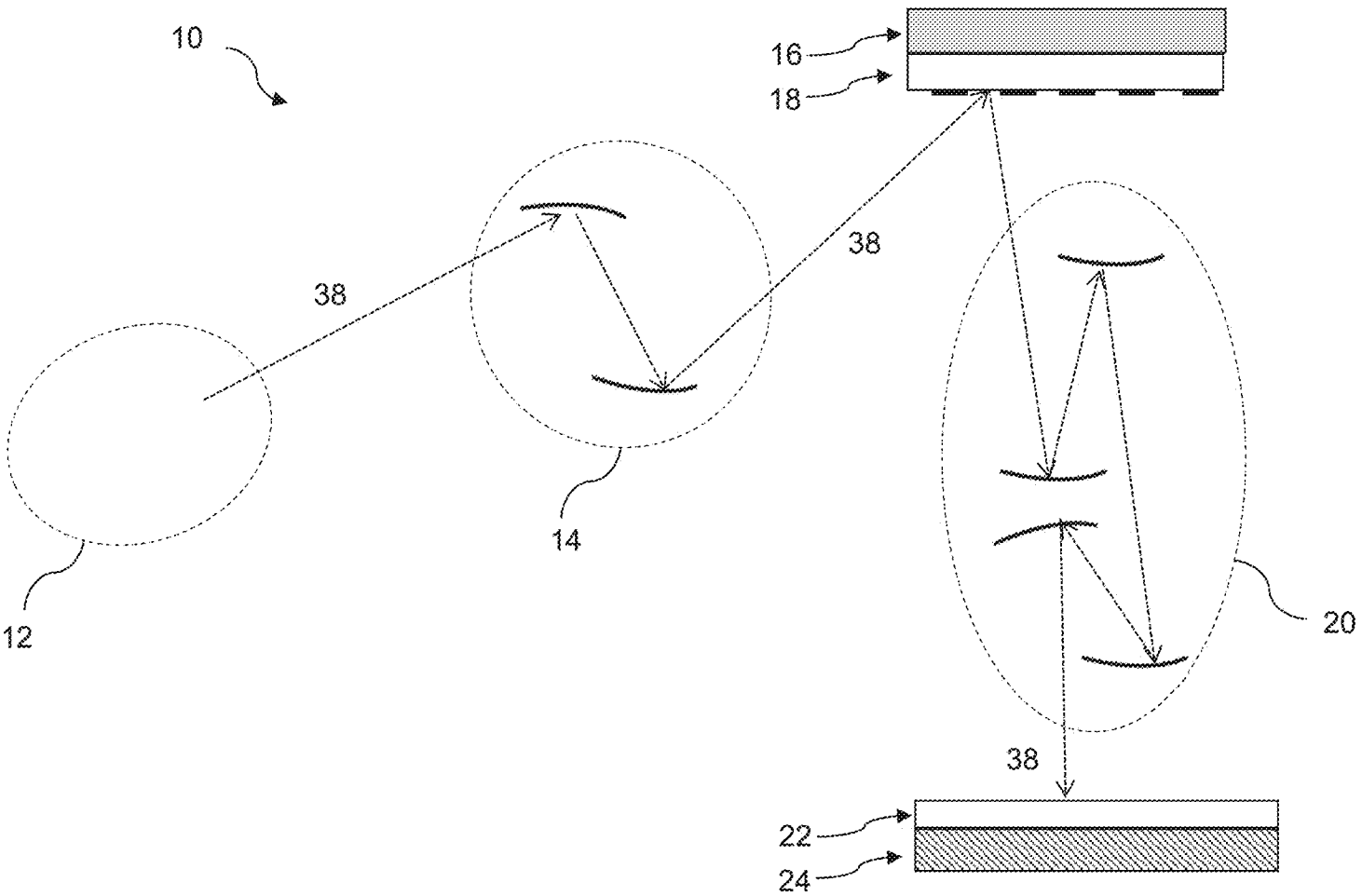
FIG. 1 is a schematic view of a EUV lithography system with a laser produced plasma (LPP) EUV radiation source, constructed in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. Still further, when a number or a range of numbers is described with "about," "approximate," and the like, the term is intended to encompass numbers that are within +/−10% of the number described, unless otherwise specified. For example, the term "about 5 nm" encompasses the dimension range from 4.5 nm to 5.5 nm.

The present disclosure is generally related to extreme ultraviolet (EUV) lithography system and methods. More particularly, it is related to apparatus and methods for improving efficiency in laser produced plasma (LPP) EUV radiation sources and mitigating contamination on LPP collectors in the LPP EUV radiation sources. One challenge in existing EUV lithography system is the low efficiency of generating EUV radiation, which directly impacts wafer throughput. An object of the present disclosure is to optimize parameters of LPP EUV radiation sources so as to improve their EUV conversion efficiency. Another challenge is the degradation of LPP collectors or EUV collectors. An LPP collector collects and reflects EUV radiation and contributes to overall EUV conversion efficiency. However, it is subjected to damages and degradations due to the impact of particles, ions, radiation, and debris deposition. Accordingly, another object of the present disclosure is directed to reducing debris deposition onto LPP collectors thereby increasing their usable lifetime.

FIG. 1 is a schematic and diagrammatic view of a lithography system 10, constructed in accordance with some embodiments. The lithography system 10 may also be generically referred to as a scanner that is operable to perform lithography exposing processes with respective radiation source and exposure mode. In the present embodiment, the lithography system 10 is an extreme ultraviolet (EUV) lithography system designed to expose a resist layer by EUV light (or EUV radiation). The resist layer is a material sensitive to the EUV light. Because gas molecules absorb EUV light, the lithography system 10 is maintained in a vacuum environment to avoid the EUV intensity loss. The EUV lithography system 10 employs a radiation source 12 to generate EUV radiation 38, such as EUV light having a wavelength ranging between about 1 nm and about 100 nm. In one particular example, the radiation source 12 generates an EUV radiation 38 with a wavelength centered at about 13.5 nm. Accordingly, the radiation source 12 is also referred to as EUV radiation source 12. In the present embodiment, the EUV radiation source 12 utilizes a mechanism of dual pulse laser-produced plasma (LPP) to generate the EUV radiation 38, which will be further described later.

The lithography system 10 also employs an illuminator 14. In various embodiments, the illuminator 14 includes reflective optics such as a single mirror or a mirror system having multiple mirrors in order to direct the EUV radiation 38 from the radiation source 12 onto a mask stage 16, particularly to a mask 18 secured on the mask stage 16. The mask stage 16 is included in the lithography system 10.

In some embodiments, the mask stage 16 includes an electrostatic chuck (e-chuck) to secure the mask 18. In the present disclosure, the terms mask, photomask, and reticle are used interchangeably. In the present embodiment, the mask 18 is a reflective mask. One exemplary structure of the mask 18 includes a substrate with a low thermal expansion material (LTEM). In various examples, the LTEM includes $TiO_2$ doped $SiO_2$, or other suitable materials with low thermal expansion. The mask 18 includes a reflective multilayers (ML) deposited on the substrate. The ML includes a plurality of film pairs, such as molybdenum-silicon (Mo/Si) film pairs (e.g., a layer of molybdenum above or below a layer of silicon in each film pair). Alternatively, the ML may include molybdenum-beryllium (Mo/Be) film pairs, or other suitable materials that are configurable to highly reflect EUV light. The mask 18 may further include a capping layer, such as ruthenium (Ru), disposed on the ML for protection. The mask 18 further includes an absorption layer, such as a tantalum boron nitride (TaBN) layer, deposited over the ML. The absorption layer is patterned to define a layer of an integrated circuit (IC). Alternatively, another reflective layer may be deposited over the ML and is patterned to define a layer of an integrated circuit, thereby forming an EUV phase shift mask.

The lithography system 10 also includes a projection optics module (or projection optics box (POB)) 20 for imaging the pattern of the mask 18 on to a semiconductor substrate 22 secured on a substrate stage 24 of the lithography system 10. The POB 20 has reflective optics (such as for EUV lithography system) in various embodiments. The light directed from the mask 18, carrying the image of the pattern defined on the mask 18, is collected by the POB 20. The illuminator 14 and the POB 20 are collectively referred to as an optical module of the lithography system 10.

In the present embodiment, the semiconductor substrate 22 is a semiconductor wafer, such as a silicon wafer or other type of wafer to be patterned. The semiconductor substrate 22 is coated with a resist layer sensitive to the EUV light in the present embodiment. Various components including those described above are integrated together and are operable to perform lithography exposing processes.

The lithography system 10 may further include other modules or be integrated with (or be coupled with) other modules. For example, the lithography system 10 may include a gas supply module designed to provide hydrogen gas to the radiation source 12. The hydrogen gas helps reduce contamination in the radiation source 12.

Figure 2:
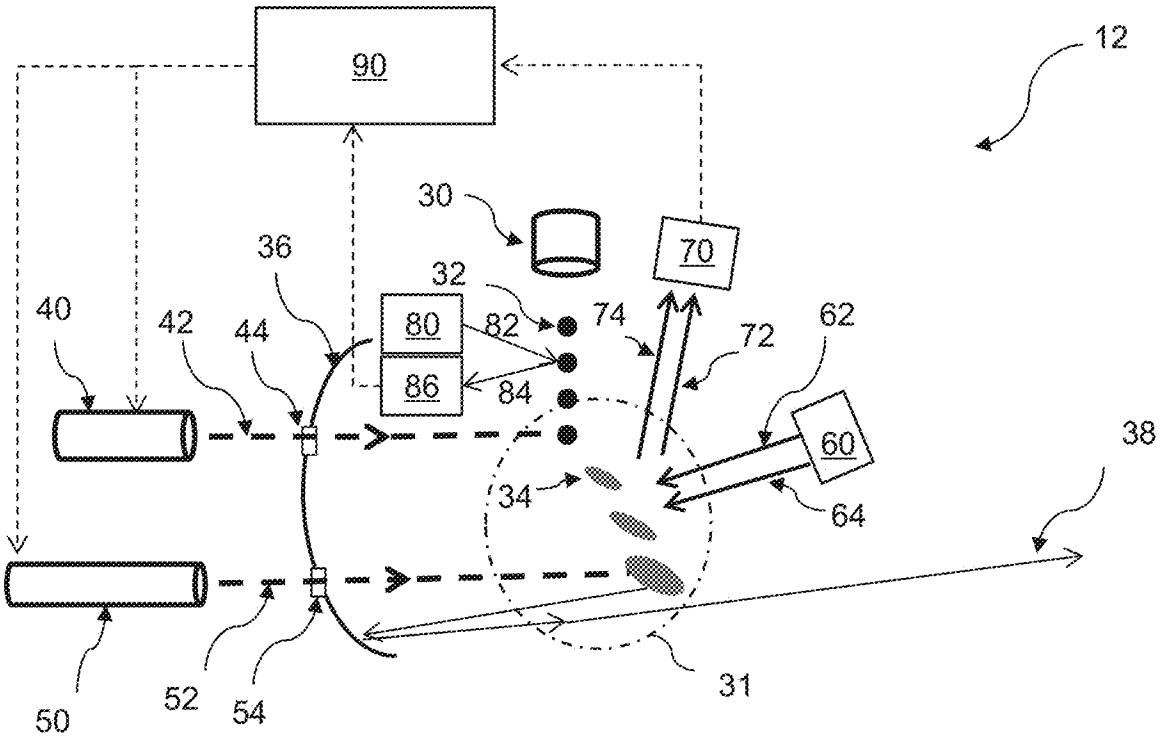
FIG. 2 is a diagrammatic view of the EUV radiation source in the EUV lithography system of FIG. 1, constructed in accordance with some embodiments.

FIG. 2 illustrates the radiation source 12 in a diagrammatical view, in accordance with some embodiments. The radiation source 12 employs a dual-pulse laser produced plasma (LPP) mechanism to generate plasma and further generate EUV radiation from the plasma.

Referring to FIG. 2, the radiation source (or EUV source) 12 includes a target droplet generator 30, a first laser source 40, a second laser source 50, an LPP collector 36, a first laser beam generator 60, a first laser beam monitor 70, a second laser beam generator 80, a second laser beam monitor 86, and a controller 90. The components of the radiation source 12 are further described below.

The target droplet generator 30 is configured to generate target droplets 32. In an embodiment, the target droplets 32 are tin (Sn) droplets, i.e. droplets having tin or tin-containing material(s) such as eutectic alloy containing tin, lithium (Li), and xenon (Xe). In an embodiment, the target droplets 32 each have a diameter about 30 microns (μm). In an embodiment, the target droplets 32 are generated at a rate about 50 kilohertz (kHz) and are introduced into a zone of excitation 31 in the radiation source 12 at a speed about 70 meters per second (m/s).

The first laser source 40 is configured to produce laser pulses 42. The second laser source 50 is configured to produce laser pulses 52. In the present embodiment, the laser pulses 42 have less intensity and smaller spot size than the laser pulses 52. Therefore, the laser pulses 42 are also referred to as the pre-pulses, and the laser pulses 52 the main pulses. The pre-pulses 42 are used to heat (or pre-heat) the target droplets 32 to create low-density target plumes 34, which are subsequently heated (or reheated) by corresponding main pulses 52, generating increased emission of EUV radiation 38. In the present embodiment, a main pulse 52 is said to be "corresponding" to a pre-pulse 42 when a target plume 34 produced by the pre-pulse 42 is heated by the main pulse 52. The EUV radiation 38 is collected by the collector 36. The collector 36 further reflects and focuses the EUV radiation 38 for the lithography exposing processes, such as illustrated in FIG. 1. In an embodiment, a droplet catcher (not shown) is installed opposite the target droplet generator 30. The droplet catcher is used for catching excessive target droplets 32. For example, some target droplets 32 may be purposely missed by both the laser pulses 42 and 52.

The collector 36 is designed with proper coating material and shape, functioning as a mirror for EUV collection, reflection, and focus. In some embodiments, the collector 36 is designed to have an ellipsoidal geometry. In some embodiments, the coating material of the collector 36 is similar to the reflective multi-layer of the EUV mask 18. In some examples, the coating material of the collector 36 includes a ML (such as a plurality of Mo/Si film pairs) and may further include a capping layer (such as Ru) coated on the ML to substantially reflect the EUV radiation 38. In some embodiments, the collector 36 may further include a grating structure designed to effectively scatter the laser beams and laser pulses directed onto the collector 36. For example, a silicon nitride layer is coated on the collector 36 and is patterned to have a grating pattern. One consideration in the EUV lithography system 10 (FIG. 1) is the usable lifetime of the collector 36. During the EUV generation processes, the reflective surface of the collector 36 is subjected to the impact of various particles, ions, and radiation. Over time, the reflectivity of the collector 36 degrades due to particle accumulation, ion damages, oxidation, blistering, etc. Among these, particle (e.g., tin debris) deposition is a dominant factor. The disclosed method and apparatus help reduce tin debris on the surface of the collector 36.

In various embodiments, the pre-pulses 42 have a spot size about 100 μm or less, and the main pulses 52 have a spot size about 200 μm-300 μm, such as 225 μm. The laser pulses 42 and 52 are generated to have certain driving powers to fulfill wafer volume production, such as a throughput of 125 wafers per hour. In an embodiment, the pre-pulses 42 are equipped with about 2 kilowatts (kW) driving power, and the main pulses 52 are equipped with about 19 kW driving power. In various embodiments, the total driving power of the laser pulses, 42 and 52, is at least 20 kW, such as 27 kW. In an embodiment, the first laser source 40 is a carbon dioxide ($CO_2$) laser source. In another embodiment, the first laser source 40 is a neodymium-doped yttrium aluminum garnet (Nd:YAG) laser source. In an embodiment, the second laser source 50 is a $CO_2$ laser source.

The pre-pulses 42 and main pluses 52 are directed through windows (or lens) 44 and 54, respectively, into the zone of excitation 31. The windows 44 and 54 adopt a suitable material substantially transparent to the respective laser pulses. The pre-pulses 42 and main pulses 52 are directed towards the target droplets 32 and target plumes 34 at proper angles for optimal EUV conversion efficiency. For example, the pre-pulses 42 may be aligned to interact with the target droplets 32 at an angle of few degrees (e.g., 5 degrees) off-normal. The main pulses 52 are also properly aligned with the target plumes 34 for maximum EUV conversion efficiency.

The generation of the pre-pulses 42 and main pulses 52 are synchronized with the generation of the target droplets 32. In an embodiment, the synchronization is achieved by utilizing the laser beam generator 80 and the laser beam monitor 86. The laser beam generator 80 is configured to produce a laser beam 82 that is directed to the travel path of the target droplets 32. When a target droplet 32 moves along the path, the laser beam 82 is reflected by the target droplet 32 and the reflected laser beam 84 is received by the monitor 86, which notifies the controller 90 about the presence of the target droplet 32. The controller 90 in turn notifies the laser source 40 to set off a trigger for generating the pre-pulse 42. In an embodiment, the laser beam monitor 86 may notify the laser source 40 directly without involving the controller 90.

Figure 3:
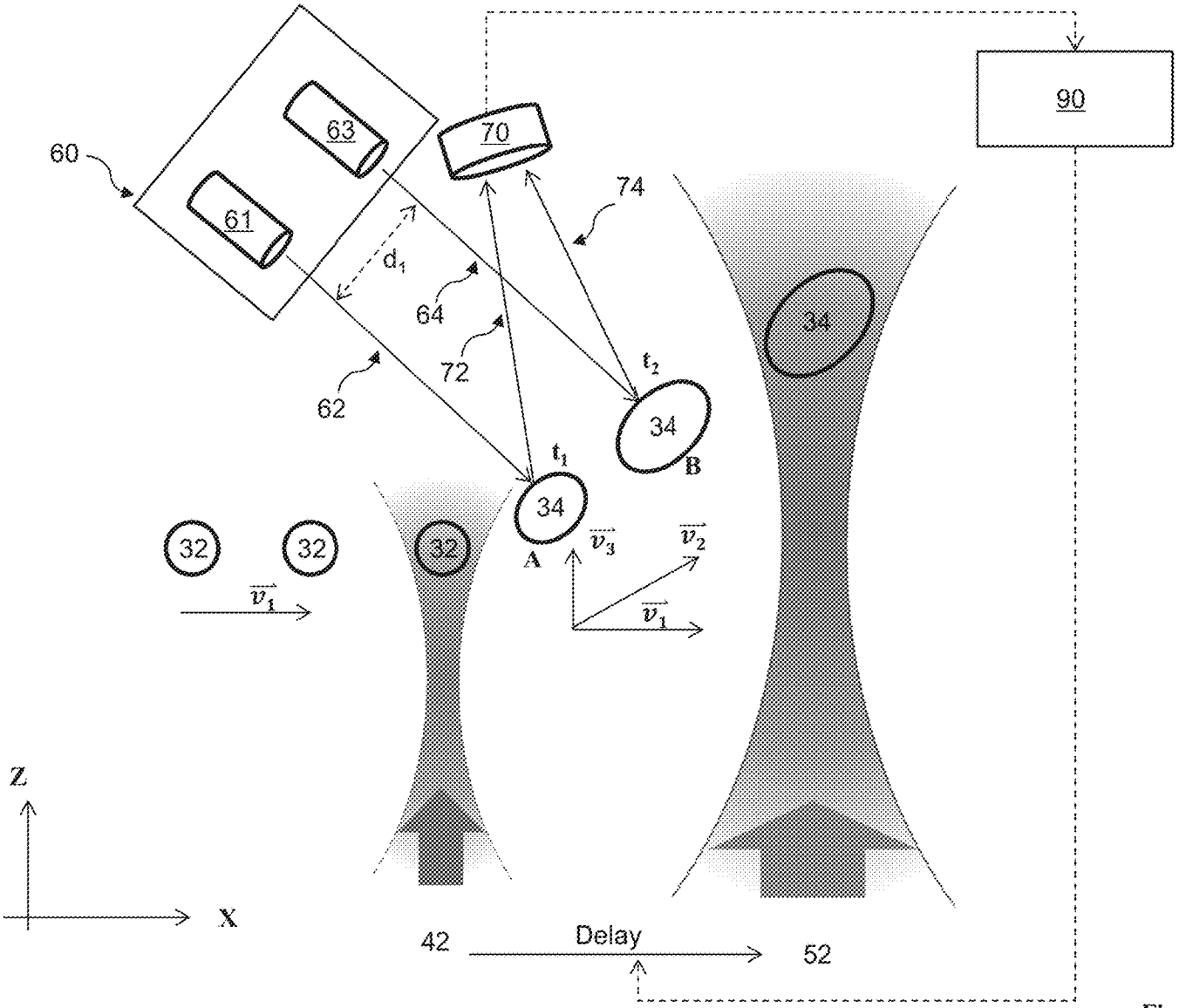
FIG. 3 illustrates a mechanism for monitoring the speed of target plumes, constructed in accordance with some embodiments.

As the target droplets 32 move through the excitation zone 31 (as illustrated in FIG. 3 where the target droplets 32 move along the X direction), the pre-pulses 42 heat the target droplets 32 (along the Z direction) and transform them into low-density target plumes 34. In the embodiment shown in FIG. 3, the X and Z directions are perpendicular. In alternative embodiments, the X and Z directions may be non-perpendicular, for example, having an 85 degree inner angle. A delay between the pre-pulse 42 and the main pulse 52 is controlled by the controller 90 to allow the target plumes 34 to form and to expand. The delay is adjustable, using methods and apparatuses of the present embodiment, so that the target plumes 34 expand to an optimal size and geometry when the main pulses 52 heat them. If the target plumes 34 are too small (under a target size), the main pulses 52 may not be able to fully convert them into EUV-irradiating plasma, lowering the EUV conversion efficiency. If the target plumes 34 are too big, some portions may be missed by the main pulses 52 and become contaminants on the LPP collector 36. Still further, the energy level of the pre-pulses 42 (which determine the speed of the target plumes 34 along the Z direction) is also properly controlled by the controller 90 so that the target plumes 34 arrive in a proper zone of the main pulses 52. If the target plumes 34 are only partially heated by the main pulses 52, then not only will the EUV conversion efficiency be lowered, but also will the excessive tin debris be deposited on the collector 36.

In the present embodiment, the laser beam generator 60 and the laser beam monitor 70 are configured to monitor the speed of the target plumes 34 along the Z direction. The monitored speed is utilized by the controller 90 for adjusting the energy level of the pre-pulses 42, the energy level of the main pulses 52, the delay between the pre-pulses 42 and the corresponding main pulses 52, other parameters of the laser sources 40 and 50, or combinations thereof. By optimizing one or more of the above parameters, the EUV conversion efficiency of the EUV source 12 and the lifetime of the collector 36 can both be improved.

Referring to FIG. 3, in the present embodiment, the laser beam generator 60 includes a laser source 61 configured to produce a laser beam 62, and a laser source 63 configured to produce a laser beam 64. When approximated to be straight lines, the laser beams 62 and 64 are parallel to each other with a distance $d_1$ that is measured along a direction perpendicular to the two laser beams 62 and 64 in the same plane that the two laser beams lie. When the spot size and dispersing effects of the laser beams 62 and 64 are taken into consideration, the above approximation may be taken along the central axis of the respective laser beams. The first and second laser beams 62 and 64 may be of the same or different wavelengths. Further, the first and second laser beams 62 and 64 may be in the visible band or invisible bands such as infrared or near infrared. In some embodiments, the laser beams 62 and 64 are substantially parallel to each other, i.e., they are considered parallel for the analysis to be discussed with reference to FIG. 3, below.

FIG. 3 illustrates a target droplet 32 at different times and locations as it moves into and through the excitation zone 31 (FIG. 2). The target droplet 32 moves with an initial velocity $\vec{v_1}$ as it is released from the target droplet generator 30. The velocity $\vec{v_1}$ is along the X direction in FIG. 3. In an embodiment, the magnitude of the velocity $\vec{v_1}$ is about 70 m/s, which can be measured and determined. After the target droplet 32 is hit by the pre-pulse 42, its velocity changes in both direction and magnitude. Its new velocity $\vec{v_2}$ is the velocity $\vec{v_1}$ combined with a velocity $\vec{v_3}$ that is caused by the pre-pulse 42. The velocity $\vec{v_3}$ is along the Z direction. In the present embodiment, the Z direction is perpendicular to the X direction.

The laser beams 62 and 64 are directed onto the path that the target plume 34 travels along. When the laser beam 62 hits the target plume 34 (at location A and time $t_1$), it is reflected as the laser beam 72. When the laser beam 64 hits the target plume 34 (at location B and time $t_2$), it is reflected as the laser beam 74. In the present embodiment, the energy level of the laser beams 62 and 64 are configured to be low enough that they do not cause any meaningful change of the velocity of the target plume 34 and high enough that the reflected laser beams 72 and 74 can be detected by the laser beam monitor 70. The reflected laser beams 72 and 74 are received by the laser beam monitor 70, which calculates the time $\Delta t = t_2 - t_1$ for the target plume 34 to travel from location A to location B. In an embodiment, the monitor 70 calculates the time $\Delta t$ using the time when it actually receives the reflected laser beams 72 and 74 as an approximation. This approximation is accurate enough because the different paths that the reflected laser beams 72 and 74 travel are negligible in the calculation, given the speed of the laser beams 72 and 74.

The controller 90 then calculates the magnitude of the velocity $\overrightarrow{v_3}$ using the time Δt and other information such as the distance $d_1$, the angle between the laser beams 62 and 64 and the X direction, and the magnitude of the velocity $\overrightarrow{v_1}$, which will be further explained with reference to FIG. 4.

The magnitude of the velocity $\overrightarrow{v_3}$ (i.e., the speed $v_3$ of the target plume 34 along the Z direction) is used by the controller 90 to adjust various parameters in the EUV source 12. For example, the controller 90 may use it to adjust the delay between the pre-pulse 42 and the corresponding main pulse 52. In an embodiment, an initial delay between the pre-pulse 42 and the corresponding main pulse 52 may be set according to an empirical value (e.g., obtained from past experiments), and the calculated speed $v_3$ is then used to adjust the delay at real-time so that the main pulse 52 is generated (or triggered) at the appropriate time to maximize EUV conversion efficiency. For another example, the controller 90 may use the calculated speed $v_3$ to adjust the energy level of the pre-pulses 42 so that the speed $v_3$ is optimized. To further this example, an optimal or near-optimal speed of the target plumes 34 along the Z direction may be determined by experiments and set in the controller 90 as a predefined speed or a range of predefined speed. If the calculated speed $v_3$ is greater than the predefined speed, then the controller 90 notifies the laser source 40 to reduce the energy level in the pre-pulse 42 which subsequently reduces the speed of the target plumes 34 along the Z direction. If the calculated speed $v_3$ is smaller than the predefined speed, then the controller 90 notifies the laser source 40 to increase the energy level in the pre-pulse 42 which subsequently increase the speed of the target plumes 34 along the Z direction. This will maintain the speed $v_3$ of the target plumes 34 in a predefined range to maximize EUV conversion efficiency and to reduce contamination on the LPP collector 36.

The monitor 70 is configured to differentiate the laser beams 72 and 74 reflected by different target plumes 34. This avoids detection aliasing, where laser beams reflected by different target plumes 34 are used in the calculation of Δt. In an embodiment, the two laser beams 72 and 74 are of different wavelengths. Alternatively, the two laser beams 72 and 74 are of the same wavelength. The monitor 70 may use the wavelength (or wavelengths) of the laser beams 72 and 74 together with other information to avoid the detection aliasing. For example, the target droplet generator 30 may be configured to generate the target droplets 32 at an interval that is much larger than an estimated Δt. Then, the monitor 70 may utilize such information to properly reject aliasing, for example, by rejecting calculated Δt that are out of range.

Figure 4:
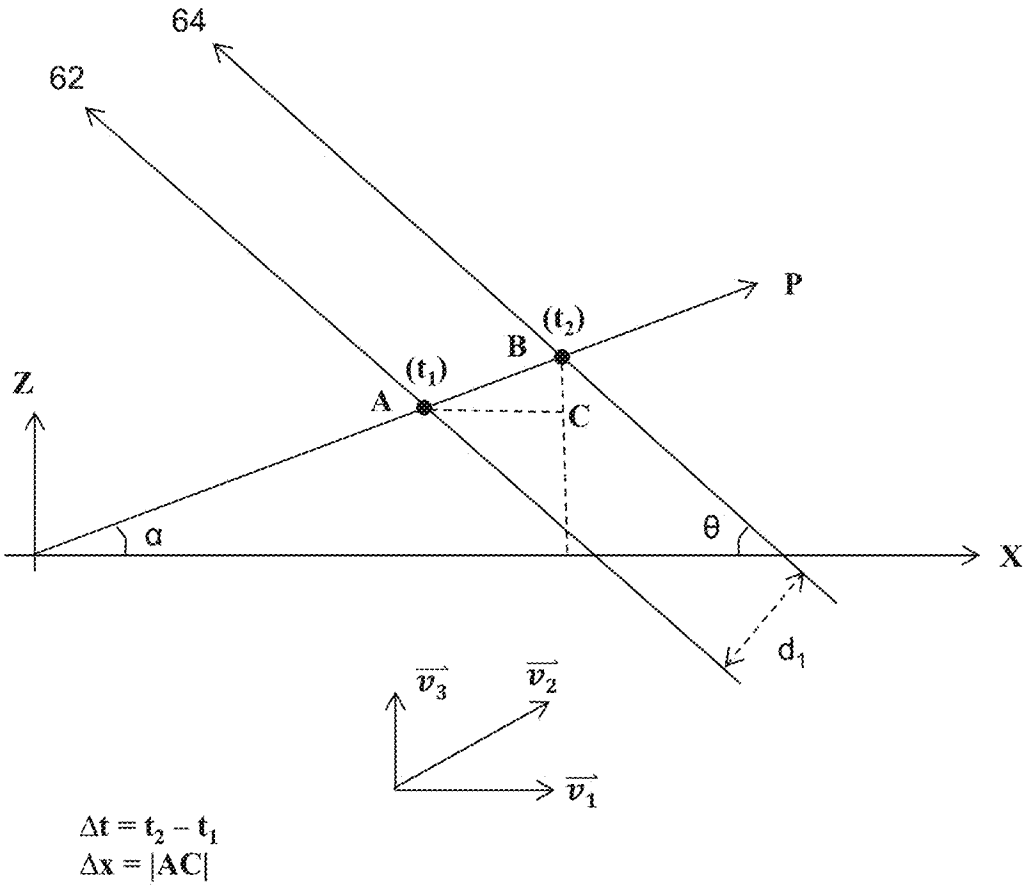
FIG. 4 illustrates a diagram for calculating the speed of target plumes, in accordance with some embodiments.

FIG. 4 illustrates a diagram for calculating the speed $v_3$ in an example. In the present embodiment, the velocity $\overrightarrow{v_1}$ is along the X direction, the velocity $\overrightarrow{v_3}$ is along the Z direction perpendicular to the X direction, and the velocity $\overrightarrow{v_2}$ is along the P direction which forms an angle α with the X direction.

$$\tan\alpha = \frac{v_3}{v_1} \tag{1}$$

From time $t_1$ to time $t_2$, the target plume 34 travels a distance |AC| along the X direction and a distance |BC| along the Z direction, which yields a total distance |AB| along the P direction (ignoring gravity and other forces including the laser beam 62 exerted onto the target plume 34). Further, the laser beams 62 and 64 are parallel with a distance $d_1$ between them, and form an angle θ with the X direction. From following equations (2) and (3):

$$\cos\alpha = \frac{|AC|}{|AB|} \tag{2}$$

$$\sin(\alpha+\theta) = \frac{d_1}{|AB|} \tag{3}$$

it can be derived that:

$$\sin\alpha\cos\theta + \cos\alpha\sin\theta = \frac{d_1}{|AC|}\cos\alpha \tag{4}$$

From equation (4), it can be derived that:

$$\tan\alpha = \frac{\sin\alpha}{\cos\alpha} = \frac{\frac{d_1}{|AC|} - \sin\theta}{\cos\theta} = \frac{\frac{d_1}{v_1\Delta t} - \sin\theta}{\cos\theta}, \text{ where } \Delta t = t_2 - t_1 \tag{5}$$

From the equations (1) and (5), it can be derived that:

$$v_3 = \frac{\frac{d_1}{\Delta t} - v_1\sin\theta}{\cos\theta}, \text{ where } \Delta t = t_2 - t_1 \tag{6}$$

When the parameters $v_1$, $d_1$, and θ are known, by measuring Δt (e.g., by the laser beam monitor 70), the speed $v_3$ can be calculated according to the equation (6). In an embodiment, the speed $v_1$ can be determined by or pre-set in the laser source 40. For example, the speed $v_1$ can be set to about 70 m/s in an embodiment. The distance $d_1$ and angle θ may be determined by configuring the laser sources 61 and 63. In an embodiment, the angle θ is set to 0 degree, where the laser beams 62/64 travel along the X direction. In another embodiment, the angle θ is set to 180 degrees, where the laser beams 62/64 travel along the reverse of the X direction. In either of the above embodiments, the equation (6) can be simplified as:

$$v_3 = \frac{d_1}{\Delta t}, \text{ where } \Delta t = t_2 - t_1 \tag{7}$$

In systems where X and Z directions are not perpendicular, the pre-pulses 42 also contribute a velocity component along the X direction to the target plume 34. In such systems, equation (7) may still be used, and equation (6) may need be adjusted to take into account the contribution of the pre-pulses 42 along the X direction. In some embodiments, the laser beams 62 and 64 are substantially parallel to each other, i.e., their non-parallelism in the excitation zone 31 is negligible for the analysis above.

By utilizing the disclosed system including the laser beam generator 60, the laser beam monitor 70, and the controller 90, the EUV source 12 is able to control various parameters in the laser sources 40 and 50 such that the EUV conversion efficiency is optimized and the contamination on the LPP collector 36 is minimized.

Figure 5:
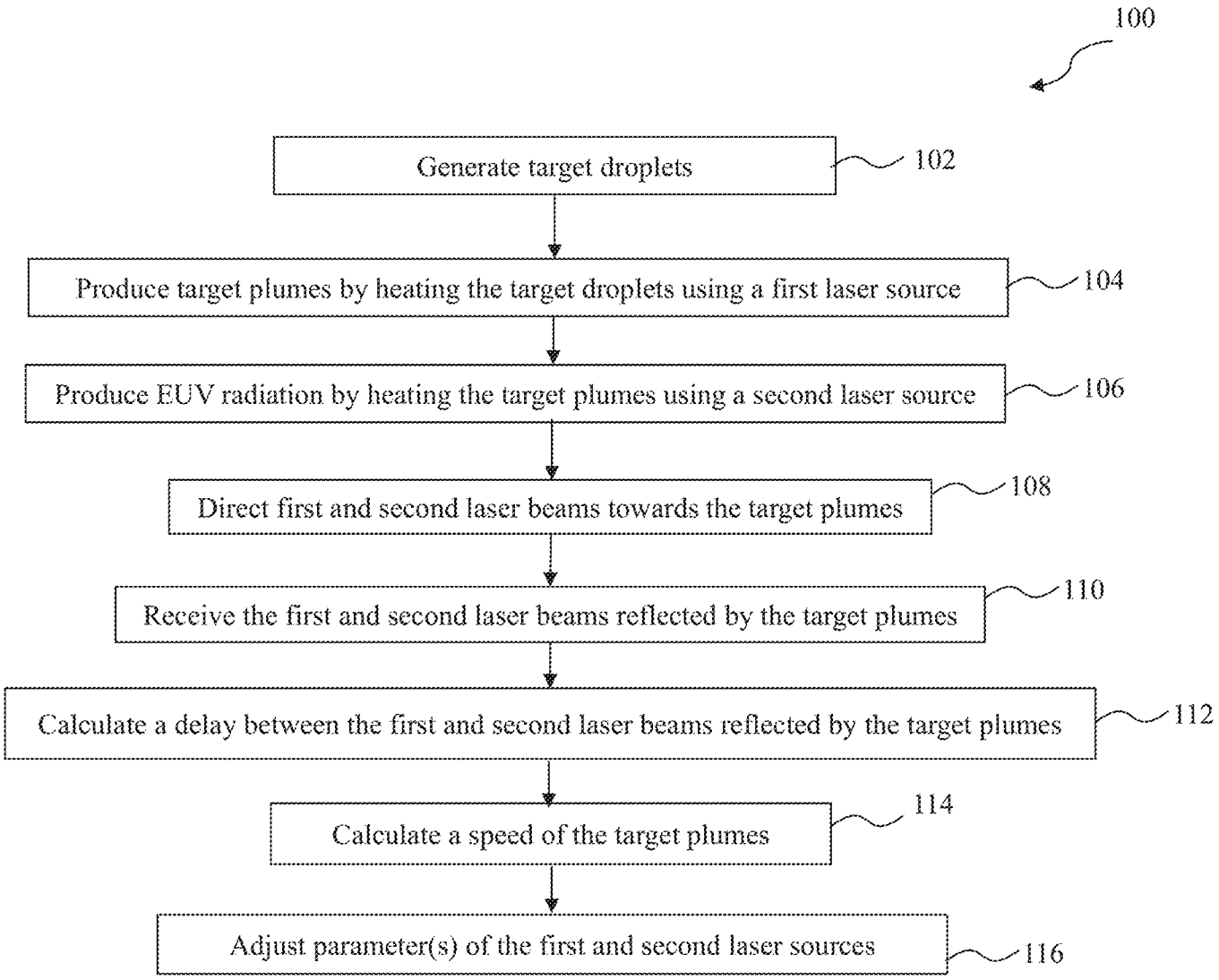
FIG. 5 is a flowchart of a method for controlling an LPP EUV radiation source, constructed in accordance with some embodiments.

FIG. 5 illustrates a method 100 for generating EUV radiation according to the present embodiment. Additional operations can be provided before, during, and after the method 100, and some operations described can be replaced, eliminated, or moved around for additional embodiments of the method. The method 100 is an example, and is not intended to limit the present disclosure beyond what is explicitly recited in the claims. The method 100 is described below in conjunction with the EUV source 12 as illustrated in FIGS. 2 and 3.

At operation 102, the method 100 generates target droplets, for example, using the target droplet generator 30 (FIG. 2). The target droplets may include a tin-containing material and are directed into a zone of excitation at a predefined speed such as about 70 m/s and along a first direction.

At operation 104, the method 100 heats the target droplets by first laser pulses to produce target plumes. For example, the first laser pulses may be produced by the first laser source 40 (FIG. 2).

At operation 106, the method 100 heats the target plumes by second laser pulses to produce EUV-irradiating plasma. For example, the second laser pulses may be produced by the second laser source 50 (FIG. 2).

At operation 108, the method 100 directs first and second laser beams towards the target plumes. For example, the first and second laser beams may be produced by the third laser source 60 (FIGS. 2 and 3). In the present embodiment, the first and second laser beams are parallel or substantially parallel to each other, and are directed along a second direction. In an embodiment, the first and second directions are parallel (i.e., they form an angle of 0° or 180°). In another embodiment, the first and second directions form an angle greater than 0° and less than 180°.

At operation 110, the method 100 receives the first and second laser beams after they have been reflected by the target plumes. For example, the reflected first and second laser beams may be received by the laser beam monitor 70 (FIGS. 2 and 3).

At operation 112, the method 100 calculates a delay between the reflected first laser beam and the reflected second laser beam. For example, the delay may be calculated by the laser beam monitor 70 or the controller 90 (FIGS. 2 and 3).

At operation 114, the method 100 calculates a speed of the target plumes along a direction that the first laser pulses travel. For example, the method 100 may calculate the speed of the target plumes using a set of data including a speed of the target droplets along the first direction, a distance between the first and second laser beams, the angle between the first and second directions, and the delay between the reflected first and second laser beams. For example, the method 100 may calculate the speed of the target plumes using the equations (6) or (7) above.

At operation 116, the method 100 adjusts one or more parameters in the first and second laser sources based on the calculated speed of the target plumes. For example, when the calculated speed of the target plumes is greater (less) than a predefined desirable speed, the method 100 may reduce (increase) the energy level in the first laser pulses. For another example, the method 100 may adjust the delay between the first laser pulses and the corresponding second laser pulses based on the calculated speed of the target plumes.

Figure 6:
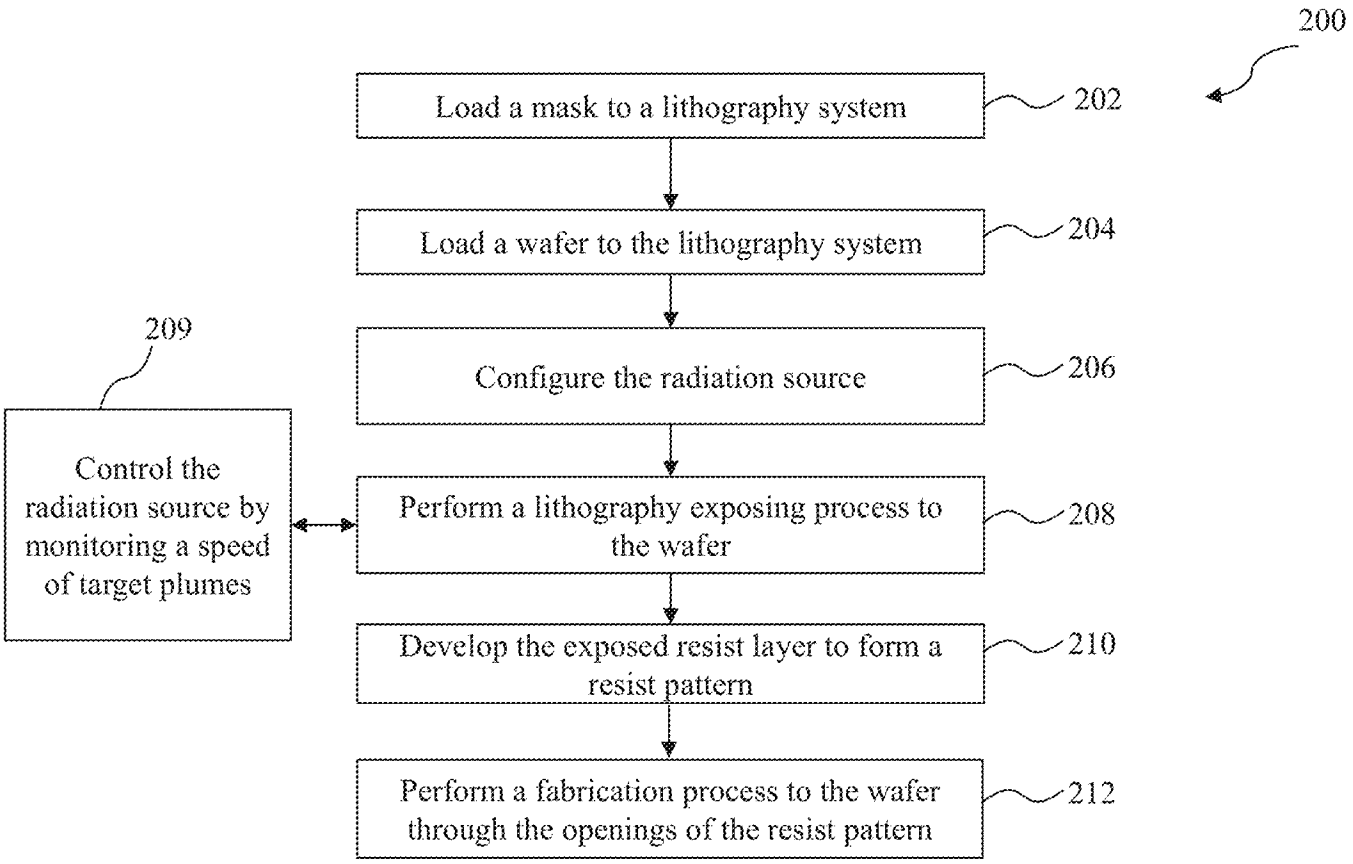
FIG. 6 is a flowchart of a lithography process constructed in accordance with some embodiments.

FIG. 6 is a flowchart of a method 200 for a EUV lithography process implemented by the EUV lithography system 10, constructed in accordance with some embodiments. Additional operations can be provided before, during, and after the method 200, and some operations described can be replaced, eliminated, or moved around for additional embodiments of the method. The method 200 is an example, and is not intended to limit the present disclosure beyond what is explicitly recited in the claims.

The method 200 includes an operation 202 which loads an EUV mask, such as the mask 18 to the lithography system 10 that is operable to perform an EUV lithography exposing process. The mask 18 includes an IC pattern to be transferred to a semiconductor substrate, such as the wafer 22. The operation 202 may further include various steps, such as securing the mask 18 on the mask stage 16 and performing an alignment.

The method 200 includes an operation 204 which loads the wafer 22 to the lithography system 10. The wafer 22 is coated with a resist layer. In the present embodiment, the resist layer is sensitive to the EUV radiation from the radiation source 12 of the lithography system 10.

The method 200 includes an operation 206 which configures the EUV radiation source 12. Operation 206 includes configuring the target droplet generator 30, configuring the first laser source 40, configuring the second laser source 50, configuring the third laser source 60, configuring the laser beam monitor 70, and configuring the controller 90. The target droplet generator 30 is configured to generate the target droplets 32 with proper material, proper size, proper rate, and proper movement speed and direction. The first laser source 40 is configured to generate the pre-pulses 42. The second laser source 50 is configured to generate the main pulses 52 a certain time after the corresponding pre-pulses 42. The third laser source 60 is configured to generate two laser beams 62 and 64 which are parallel or substantially parallel to each other. The laser beam monitor 70 is configured to receive the laser beams 62 and 64 after they have been reflected by target plumes and to calculate a delay between the reflected laser beams 72 and 74. The controller 90 is configured to calculate a speed of the target plumes using the delay between the reflected laser beams 72 and 74, as well as other information. The controller 90 may be configured to have a predefined range of desirable speed of the target plumes.

The method 200 includes an operation 208 by performing a lithography exposing process to the wafer 22 in the lithography system 10. In the operation 208, the target droplet generator 30 and the laser sources 40 and 50 are turned on and are operated according to the configuration in the operation 206. The pre-pulses 42 heat the target droplets 32 to produce target plumes 34. The main pulses 52 heat the target plumes 34, producing plasma, which emits EUV radiation. During the operation 208, the EUV radiation generated by the radiation source 12 is illuminated on the mask 18 (by the illuminator 14), and is further projected on the resist layer coated on the wafer 22 (by the POB 20), thereby forming a latent image on the resist layer. In some embodiments, the lithography exposing process is implemented in a scan mode.

The method 200 includes an operation 209 which controls the EUV radiation source 12 to optimize EUV conversion efficiency by monitoring the speed of target plumes. During the operation 209, the first and second laser beams 62 and 64 are directed towards the target plumes 34. The laser beam monitor 70 receives the reflected first and second laser beams 72 and 74 and calculates a delay between the reflected laser beams 72 and 74. The controller 90 calculates a speed of the target plumes using the delay between the reflected laser beams 72 and 74, as well as other information. The first laser source 40 may adjust an energy level in the pre-pulses 42 based on the calculated speed of the target plumes. The second laser source 50 may adjust a delay between a main pulse 52 and a corresponding pre-pulse 42 based on the calculated speed of the target plumes. The operation 209 ensures that the target plumes 34 have optimal shape and size when heated by the main pulses 52, thereby increasing EUV conversion efficiency and reducing the amount of debris on the LPP collector 36. In the present embodiment, the operations 208 and 209 are performed simultaneously.

The method 200 may include other operations to complete the lithography process. For example, the method 200 may include an operation 210 by developing the exposed resist layer to form a resist pattern having a plurality of openings defined thereon. Particularly, after the lithography exposing process at the operation 208, the wafer 22 is transferred out of the lithography system 10 to a developing unit to perform a developing process to the resist layer. The method 200 may further include other operations, such as various baking steps. As one example, the method 200 may include a post-exposure baking (PEB) step between the operations 208 and 210.

The method 200 may further include other operations, such as an operation 212 to perform a fabrication process to the wafer through the openings of the resist pattern. In one example, the fabrication process includes an etch process to the wafer 22 using the resist pattern as an etch mask. In another example, the fabrication process includes an ion implantation process to the wafer 22 using the resist pattern as an implantation mask.

Although not intended to be limiting, one or more embodiments of the present disclosure provide many benefits to the manufacturing of a semiconductor device. For example, embodiments of the present disclosure provide apparatus and methods for increasing EUV conversion efficiency while reducing contamination on LPP collectors. Embodiments of the present disclosure can be implemented or integrated into existing EUV lithography systems.

In one exemplary aspect, the present disclosure is directed to an extreme ultraviolet (EUV) radiation source module. The EUV radiation source module includes a target droplet generator configured to generate target droplets; a first laser source configured to generate first laser pulses that heat the target droplets to produce target plumes; a second laser source configured to generate second laser pulses that heat the target plumes to produce plasma emitting EUV radiation; third and fourth laser sources configured to generate first and second laser beams, respectively, that are directed onto a travel path of the target plumes, wherein the first and second laser beams are substantially parallel; and a monitor configured to receive the first and second laser beams reflected by the target plumes.

In an embodiment, the EUV radiation source module further includes a controller configured to adjust at least one parameter of the first and second laser sources based on a set of data including a distance between the first and second laser beams and a delay between the first and second laser beams when received by the monitor. In a further embodiment, the set of data further includes an angle between a travel direction of the first and second laser beams and another travel direction of the target droplets. In a further embodiment, the set of data further includes a speed of the target droplets. In another further embodiment, wherein the angle is configured to be 0 degree or 180 degrees. In some embodiments, the at least one parameter includes an energy level of the first laser pulses. In some embodiments, the at least one parameter includes a delay between one of the first laser pulses and a corresponding one of the second laser pulses that heats a target plume produced by the one of the first laser pulses.

In an embodiment, the EUV radiation source module further includes a collector configured to collect and reflect the EUV radiation. In an embodiment, the EUV radiation source module further includes a fifth laser source configured to generate a third laser beam that is directed onto a travel path of the target droplets; and another monitor configured to receive the third laser beam reflected by the target droplets.

In another exemplary aspect, the present disclosure is directed to an extreme ultraviolet (EUV) lithography system. The EUV lithography system includes a radiation source. The radiation source includes a target droplet generator configured to generate target droplets; a first laser source configured to generate first laser pulses that heat the target droplets to produce target plumes; a second laser source configured to generate second laser pulses that heat the target plumes to produce plasma emitting EUV radiation; third and fourth laser sources configured to generate first and second laser beams, respectively, that are directed onto a travel path of the target plumes, wherein the first and second laser beams are parallel; a monitor configured to receive the first and second laser beams reflected by the target plumes; and a collector configured to collect and reflect the EUV radiation. The EUV lithography system further includes a mask stage configured to secure an EUV mask; a wafer stage configured to secure a semiconductor wafer; and one or more optical modules configured to direct the EUV radiation from the radiation source to image an integrated circuit (IC) pattern defined on the EUV mask onto the semiconductor wafer.

In an embodiment, the EUV lithography system further includes a controller configured to calculate a first speed of the target plumes along a direction that the first laser pluses travel. In a further embodiment, the controller is further configured to calculate the first speed based on a set of data including a distance between the first and second laser beams and a delay between the first and second laser beams when received by the monitor. In another further embodiment, the set of data further includes an angle between a travel direction of the first and second laser beams and another travel direction of the target droplets. In a further embodiment, the controller is further configured to adjust an energy level of the first laser pulses based on at least the first speed. In yet another further embodiment, the controller is further configured to adjust a delay between one of the first laser pulses and a corresponding one of the second laser pulses that heats a target plume produced by the one of the first laser pulses.

In yet another exemplary aspect, the present disclosure is directed to a method for extreme ultraviolet (EUV) lithography. The method includes generating a target droplet; producing a target plume by heating the target droplet with a first laser pulse generated by a first laser source; directing first and second laser beams onto a travel path of the target plume, wherein the first and second laser beams are parallel; receiving the first and second laser beams reflected by the target plume; and producing EUV-radiating plasma by heating the target plume with a second laser pulse generated by a second laser source.

In an embodiment, the method further includes calculating a delay between when the first laser beam is reflected by the target plume and when the second laser beam is reflected by the target plume. In a further embodiment, the method further includes calculating a first speed of the target plume along a direction that the first laser pulse travels. In another embodiment, the method further includes adjusting an energy level of the first laser source. In yet another embodiment, the method further includes adjusting a trigger delay between the first laser source and the second laser source.

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions, and alterations herein without departing from the spirit and scope of the present disclosure.

What is claimed is:

1. A method for extreme ultraviolet (EUV) lithography, the method comprising:

loading an EUV mask to a lithography system;

loading a wafer to the lithography system, wherein the wafer includes a resist layer sensitive to EUV radiation;

producing EUV radiation by heating target plumes using a radiation source; and exposing the resist layer to the EUV radiation while monitoring a speed of the target plumes.

2. The method of claim 1, wherein the monitoring of the speed of the target plumes includes:

directing first and second laser beams onto the target plumes;

receiving the first and the second laser beams reflected by the target plumes; and calculating a first delay between when the first laser beam reflected by the target plumes is received and when the second laser beam reflected by the target plumes is received.

3. The method of claim 2, further comprising:

adjusting at least one of parameters of the radiation source based on information derived from at least the first delay.

4. The method of claim 3, wherein the parameters of the radiation source includes an energy level of first laser pulses produced by the radiation source and used for heating target droplets to produce the target plumes, an energy level of second laser pulses produced by the radiation source and used for heating the target plumes, and a second delay between the first laser pulses and corresponding ones of the second laser pulses.

5. The method of claim 1, further comprising:

developing the resist layer after the exposing of the resist layer.

6. The method of claim 5, wherein the developing of the resist layer produces a resist pattern, further comprising:

performing a fabrication process to the wafer using the resist pattern as a mask.

7. The method of claim 1, further comprising:

adjusting at least one of parameters of the radiation source based on information derived from the speed of the target plumes.

8. The method of claim 1, wherein the producing of the EUV radiation includes:

generating target droplets;

heating the target droplets with first laser pulses produced by the radiation source, wherein the heating of the target droplets produces the target plumes; and heating the target plumes with second laser pulses produced by the radiation source, wherein the second laser pulses have higher driving power than the first laser pulses.

9. The method of claim 8, wherein the speed of the target plumes is defined along a direction at which the first laser pulses travel.

10. A method for extreme ultraviolet (EUV) lithography, the method comprising:

generating target droplets;

producing target plumes by heating the target droplets with first laser pulses; and deriving a speed of the target plumes along a direction at which the first laser pulses travel.

11. The method of claim 10, wherein the deriving of the speed of the target plumes includes:

directing first and second laser beams onto the target plumes; and receiving the first and the second laser beams reflected by the target plumes.

12. The method of claim 11, wherein the deriving of the speed of the target plumes further includes:

calculating a delay between when the first laser beam reflected by the target plumes is received and when the second laser beam reflected by the target plumes is received.

13. The method of claim 11, wherein the first and the second laser beams are substantially parallel to each other.

14. The method of claim 10, further comprising:

adjusting an energy level of the first laser pulses based on at least information derived from the speed.

15. The method of claim 10, further comprising:

heating the target plumes with second laser pulses that have higher driving power than the first laser pulses, thereby producing EUV radiation.

16. The method of claim 15, further comprising:

directing the EUV radiation to a wafer coated with a resist layer sensitive to the EUV radiation.

17. An extreme ultraviolet (EUV) lithography system, comprising:

a radiation source for producing EUV radiation, wherein the radiation source includes:

a target droplet generator configured to generate target droplets;

a first laser source configured to generate first laser pulses that heat the target droplets to produce target plumes;

a first laser beam generator configured to generate first and second laser beams that are directed onto the target plumes; and a first laser beam monitor configured to receive the first and the second laser beams reflected by the target plumes;

a mask stage configured to secure an EUV mask; and one or more optical modules configured to direct the EUV radiation from the radiation source towards the mask stage.

18. The EUV lithography system of claim 17, wherein the radiation source further includes a second laser source configured to generate second laser pulses that heat the target plumes to produce the EUV radiation, wherein the second laser pulses have higher driving power than the first laser pulses.

19. The EUV lithography system of claim 17, wherein the radiation source further includes:

a second laser beam generator configured to generate a third laser beam that is directed onto the target droplets; and a second laser beam monitor configured to receive the third laser beam reflected by the target droplets.

20. The EUV lithography system of claim 17, wherein the radiation source further includes a controller that is configured to receive information from the first laser beam monitor and to derive a speed of the target plumes along a direction at which the first laser pulses travel based on the information.

* * * * *